US007744204B2

(12) United States Patent
Yokoyama et al.

(10) Patent No.: US 7,744,204 B2
(45) Date of Patent: Jun. 29, 2010

(54) LIQUID DISCHARGE APPARATUS AND LIQUID DISCHARGE DEVICE GROUP CAPABLE OF CHANGING FLUID RESISTANCE

(75) Inventors: Seiichi Yokoyama, Tomi (JP); Kazutomo Seki, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 468 days.

(21) Appl. No.: 11/751,801

(22) Filed: May 22, 2007

(65) Prior Publication Data

US 2007/0279460 A1 Dec. 6, 2007

(30) Foreign Application Priority Data

May 30, 2006 (JP) ..... 2006-149363

(51) Int. Cl.
*B41J 2/17* (2006.01)

(52) U.S. Cl. ..... 347/94; 347/65; 347/68

(58) Field of Classification Search ..... 347/20, 347/44, 47, 56, 65, 67, 68, 70–72, 92–94
See application file for complete search history.

(56) References Cited

U.S. PATENT DOCUMENTS 4,514,742 A * 4/1985 Suga et al. ..... 347/85

FOREIGN PATENT DOCUMENTS

| | | |
|---|---|---|
| JP | 2005-47165 | 2/2005 |
| JP | 2005-67047 | 3/2005 |

* cited by examiner

*Primary Examiner*—Juanita D Stephens
(74) *Attorney, Agent, or Firm*—Ditthavong Mori & Steiner, P.C.

(57) ABSTRACT

A liquid discharge apparatus includes a nozzle, a pressure chamber, a liquid supply chamber, a liquid supply passage, and a fluid resistance changing mechanism. A liquid pressure in the pressure chamber is configured to be changed to discharge liquid from the nozzle. The liquid supply passage extends in a connecting direction to connect the liquid supply chamber and the pressure chamber. The fluid resistance changing mechanism is configured to change a fluid resistance of the liquid supply passage.

20 Claims, 11 Drawing Sheets

LIQUID DISCHARGE APPARATUS AND LIQUID DISCHARGE DEVICE GROUP CAPABLE OF CHANGING FLUID RESISTANCE

CROSS-REFERENCE TO RELATED APPLICATIONS

The present application claims priority under 35 U.S.C. §119 to Japanese Patent Application No. 2006-149363, filed May 30, 2006, entitled "LIQUID DISCHARGE APPARATUS AND LIQUID DISCHARGE DEVICE GROUP." The contents of this application are incorporated herein by reference in their entirety.

BACKGROUND OF THE INVENTION

1. Field of the Invention

The present invention relates to a liquid discharge apparatus and a liquid discharge device group.

2. Discussion of the Background

As shown in FIG. 13, an inkjet apparatus of a printer includes a nozzle hole 201 through which fluid (liquid ink) is discharged, a pressure chamber 202, a supply passage 203, and a fluid supply chamber 204 which are formed in a head body 207 by means of photo-etching or the like. The inkjet apparatus further includes a diaphragm 205 to cover an upper opening of the pressure chamber 202 and an actuator 206 for moving the diaphragm 205 up and down. Liquid ink is supplied to the fluid supply chamber 204 through a supply inlet 204*a* and is then supplied to the pressure chamber 202 through supply passage 203 so that the pressure chamber 202 and the nozzle hole 201 are filled with the liquid ink.

To conduct printing by the inkjet apparatus, the diaphragm 205 is moved up and down by causing the actuator 206 to vibrate up and down so that the pressure of the fluid inside the pressure chamber 202 varies. As the inner pressure of the pressure chamber 202 is increased by the downward movement of the diaphragm 205, the inner fluid (liquid ink) is discharged from an end opening 201*a* of the nozzle hole 201. When the inner pressure of the pressure chamber 202 is increased, the inner fluid is not only discharged through the nozzle hole 201 but also flowing back into the fluid supply chamber 204 at the same time. In the inkjet apparatus, therefore, the supply passage 203 is structured to have a reduced cross-section (throttled) in a passage connecting the pressure chamber 202 and the fluid supply chamber 204 so as to provide fluid resistance to the aforementioned back flow. Generally, it is designed to make the fluid resistance in the supply passage 203 substantially equal to the fluid resistance in the nozzle hole 201.

On the other hand, as the diaphragm 205 is moved upward by the actuator 206, the diaphragm 205 operates to increase the volume of the pressure chamber 202 so as to decrease the inner pressure. During this, fluid in the nozzle hole 201 is sucked toward the pressure chamber 202. However, meniscus is formed because of the surface tension of fluid at the end opening 201*a*, thereby preventing air from being sacked into the pressure chamber 202. At the same time, fluid in the fluid supply chamber 204 is sucked through the supply passage 203 and is supplied into the pressure chamber 202. Inkjet apparatuses as mentioned above are disclosed, for example, in Japanese Unexamined Patent Application Publications Nos. 2005-47165 and 2005-67047. The contents of these publications are incorporated by reference in their entirety.

SUMMARY OF THE INVENTION

According to one aspect of the present invention, a liquid discharge apparatus includes a nozzle, a pressure chamber, a liquid supply chamber, a liquid supply passage, and a fluid resistance changing mechanism. A liquid pressure in the pressure chamber is configured to be changed to discharge liquid from the nozzle. The liquid supply passage extends in a connecting direction to connect the liquid supply chamber and the pressure chamber. The fluid resistance changing mechanism is configured to change a fluid resistance of the liquid supply passage.

According to another aspect of the present invention, a liquid discharge device group includes a common liquid supply chamber and a plurality of liquid discharge devices. Each of the plurality of liquid discharge devices includes a nozzle, a pressure chamber, a liquid supply passage, and a fluid resistance changing mechanism. A liquid pressure in the pressure chamber is configured to be changed to discharge liquid from the nozzle. The liquid supply passage extends in a connecting direction to connect the common liquid supply chamber and the pressure chamber. The fluid resistance changing mechanism is configured to change a fluid resistance of the liquid supply passage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
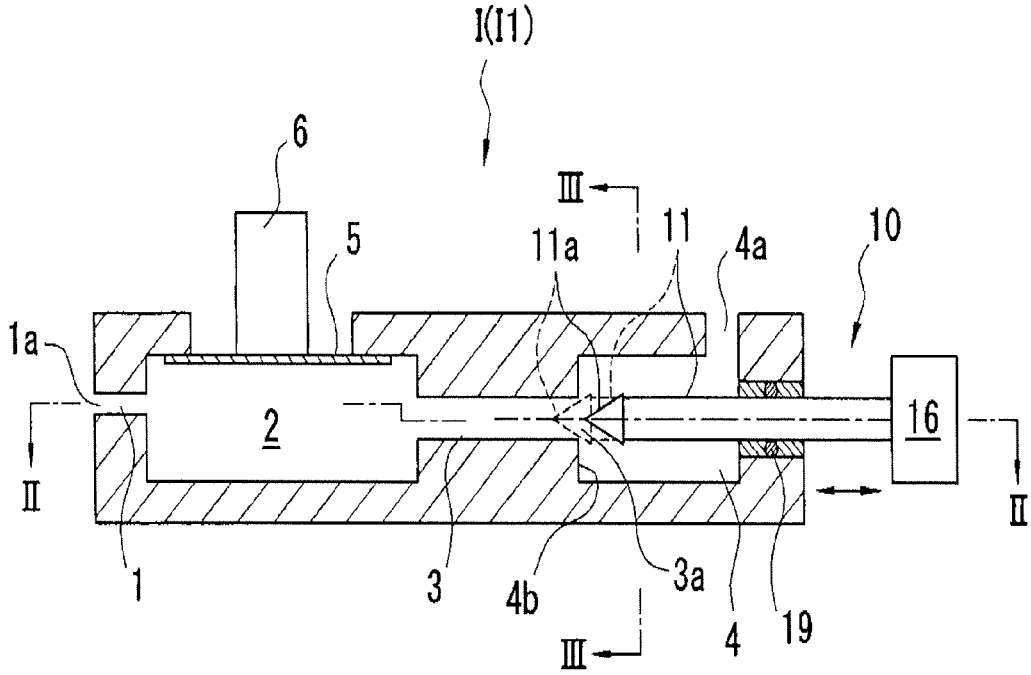
FIG. 1 is a front sectional view of inkjet apparatuses provided with a resistance adjusting mechanism according to a first embodiment of the present invention.

The embodiments will now be described with reference to the accompanying drawings, wherein like reference numerals designate corresponding or identical elements throughout the various drawings.

Since a fluid discharge apparatus according to the present invention is suitably used for an inkjet apparatus of a printer, the following description will be made on the premise that the fluid discharge apparatus is applied to an inkjet apparatus. However, it should be understood that the fluid discharge apparatus according to the present invention is not limited to be applied to an inkjet apparatus and may be applied to other fluid discharge applications.

In an industrial printer, it is required to change the physicality of ink to be used, the ejection velocity, and the ejection amount according to the material of the substrate to be printed.

FIG. 1 shows an inkjet apparatus I (I1-I4). Referring to FIG. 1, the inkjet apparatus includes a head body 7 and further includes a nozzle hole 1, a pressure chamber 2, a supply passage 3, and a fluid supply chamber 4 which are formed in the head body 7, a diaphragm 5 which is mounted to cover an upper opening of the pressure chamber 2, and an actuator 6 such as a piezoelectric element for moving the diaphragm 5 up and down. The supply passage 3 is formed to have a circular cross-section and to extend linearly along the center line.

Figure 2:
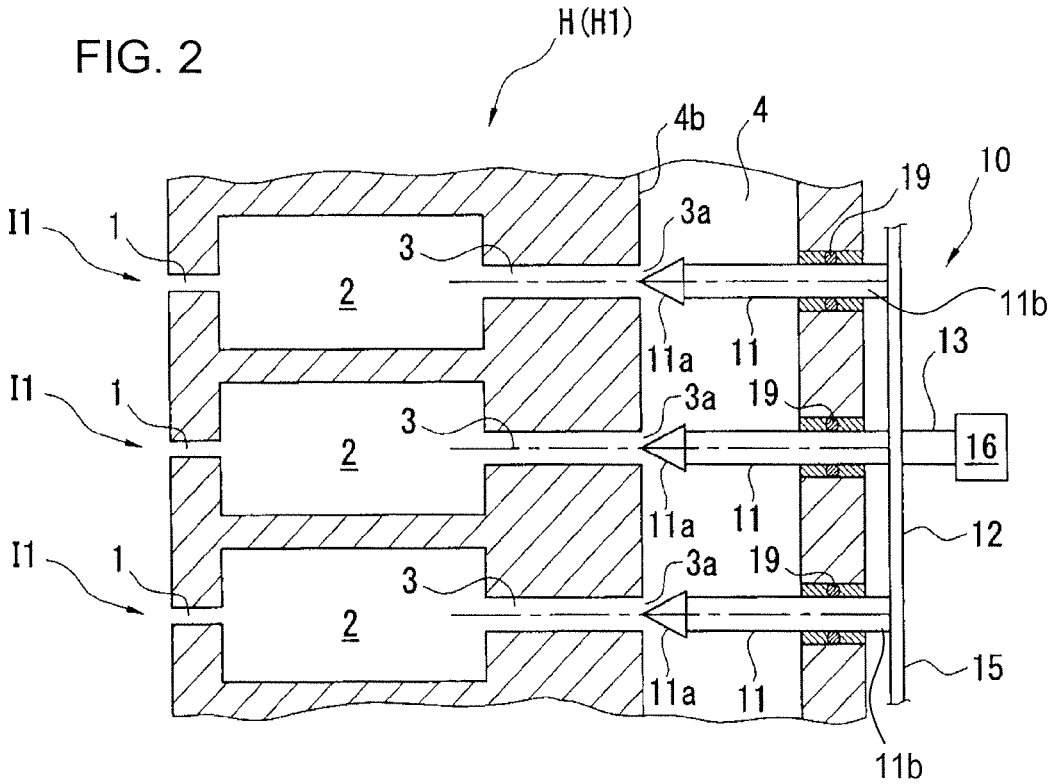
FIG. 2 is a plan sectional view of the inkjet apparatuses taken along a line shown by arrows II-II of FIG. 1.
Figure 3:
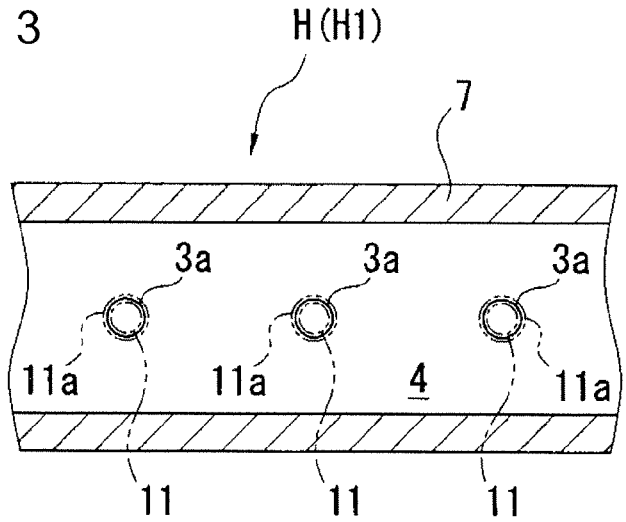
FIG. 3 is a side sectional view of the inkjet apparatuses taken along a line shown by arrows III-III of FIG. 1.

As shown in FIG. 2, a plurality of inkjet apparatuses I are aligned along a lateral direction to compose a printer head H (H1-H4) of a printer. In the printer head H, the head bodies 7 of the respective inkjet apparatuses I are formed integrally. A plurality of nozzle holes 1 are formed to open at the end of the integral head body 7 and are aligned along the lateral direction. The fluid supply chambers 4 of the respective inkjet apparatuses I are composed of a single common space. As shown in FIG. 3, a plurality of supply passages 3 connecting to the respective pressure chambers 2 are formed and aligned along a lateral direction to open at one of walls 4*b* defining the fluid supply chamber 4 as the single common space.

Figure 4:
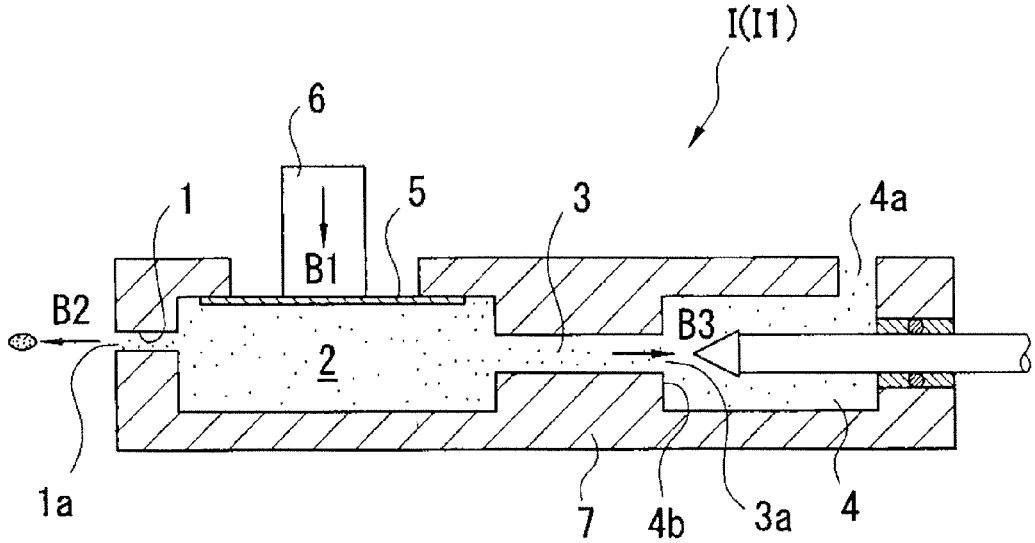
FIG. 4 is a front sectional view for explaining the operation of the inkjet apparatus.

To conduct printing, the printer head H (the inkjet apparatuses I) moves the diaphragm 5 up and down by applying predetermined electric current to the piezoelectric element to vibrate the actuator 6 up and down. As the diaphragm 5 is moved downwards by the actuator 6 as shown by an arrow B1 of FIG. 4, the inner pressure of the pressure chamber 2 is increased so that inner fluid, i.e. liquid ink, inside the pressure chamber 2 is broken into droplets and discharged from an end opening 1*a* of the nozzle hole 1 as shown by an arrow B2. In this manner, the liquid ink is jetted onto a print substrate which is placed to face the nozzle hole 1, thereby printing on the print substrate. When the inner pressure of the pressure chamber 2 is increased, the inner fluid is not only discharged through the nozzle hole 1 but also flowing back into the supply side, i.e. the fluid supply chamber 4, through the fluid passage 3 at the same time as shown by an arrow B3 (causing reverse flow into the supply passage 3).

Figure 5:
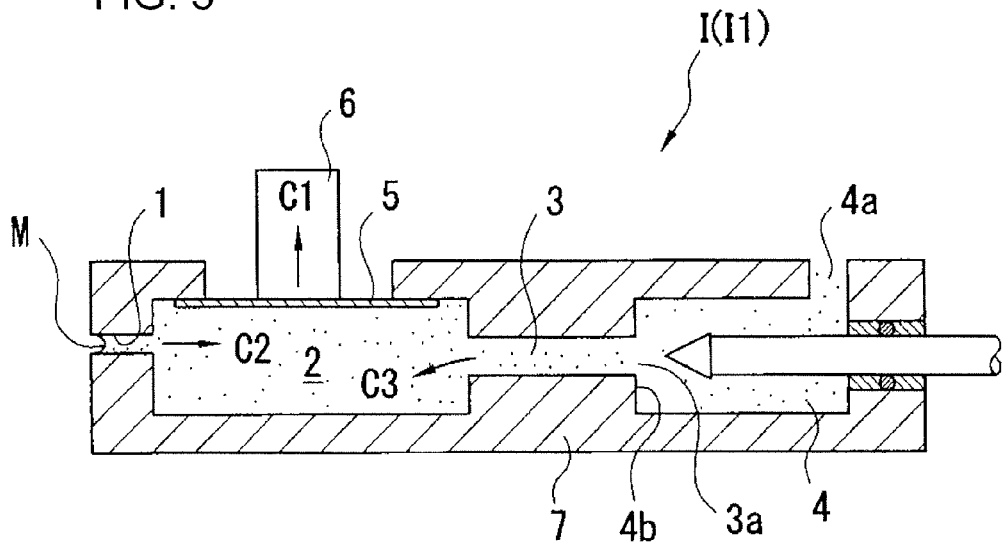
FIG. 5 is a front sectional view for explaining the operation of the inkjet apparatuses.

As the diaphragm 5 is moved upwards by the actuator 6 as shown by an arrow C1 in FIG. 5, the diaphragm 5 operates to increase the volume inside the pressure chamber 2 so as to decrease the inner pressure. In this case, fluid in the nozzle hole 1 is sucked toward the pressure chamber 2 as shown by an arrow C2. However, meniscus M is formed because of the surface tension of fluid at the end opening 1*a*, thereby preventing air from being sacked into the pressure chamber 2. At the same time, fluid in the fluid supply chamber 4 is sucked through the supply passage 3 and is supplied into the pressure chamber 2 as shown by an arrow C3 (causing forward flow into the supply passage 3).

In case that the printer is structured to be used for, for example, industrial applications and thus to print on print substrates of various sizes and various materials, it is required to change the physicality of liquid ink to be used, the velocity and the amount of ink discharge through the nozzle hole 1 according to the material of the print substrate and the intended use of the printed matter. The inkjet apparatus I (the printer head H) is provided with a resistance adjusting mechanism for changing the fluid resistance inside the supply passage 3 for the purpose of changing the setting of the velocity and the amount of ink discharge.

The resistance adjusting mechanism 10 of a first embodiment shown in FIG. 1 and FIG. 2 includes a plurality of rods 11 each having a tip end 11*a* which is formed into a circular cone shape. The plurality of rods 11 are aligned along a lateral direction to extend from the outside of the head body 7 into the fluid supply chamber 4 such that the tip ends 11*a* confront openings 3*a* of the supply passages 3. The head body 7 is provided with sealing members 19 such as O-rings disposed at portions through which the rods 11 are inserted, thereby preventing leakage of the ink from the fluid supply chamber 4 to the outside. Outside of the head body 7, the plurality of rods 11 are connected to each other at their proximal ends 11*b* by a bar 12 extending in the lateral direction. The plurality of rods 11 and the bar 12 cooperate together to form a comb-like movable member 15.

The movable member 15 is provided with a shaft 13 extending in a direction, opposite to the extending direction of the rods 11, from a middle portion in the lateral direction of the bar 12. The resistance adjusting mechanism 10 is provided with a drive unit 16 for moving the shaft 13 in the axial direction.

According to the resistance adjusting mechanism 10 having the aforementioned structure, the shaft 13 is moved in the axial direction by the actuation of the drive unit 16 so as to move the plurality of rods 11 in the axial direction (the tip ends 11*a* in the cone axial direction) concurrently. By this movement, the tip end 11*a* of each rod 11 enters into and retracts from the supply passages 3 through the openings 3*a*. As the amount of leftward movement is increased, the amount of insertion of the tip end into the supply passage 3 is increased so that the opening area of the supply passage 3 relative to the fluid supply chamber 4 is decreased. The movable member 15 is movable between a position where the tip end 11*a* is spaced apart from the wall, at which the supply passage 3 opens, to fully open the supply passage 3 (see solid lines in FIG. 1) and a position where the peripheral surface of the tip end 11*a* is in contact with the periphery of the opening of the supply passage 3 to fully close the supply passage 3 (see broken lines in FIG. 1).

As mentioned above, the opening area of the supply passage 3 (the throttled amount of the aperture) is changed according to the insertion amount of the tip end 11*a* relative to the supply passage, thereby changing the fluid resistance inside the supply passage 3. That is, by controlling the movement of the shaft 13 driven by the drive unit 16, the fluid resistance inside the supply passage 3 is controlled. For example, to increase the amount of discharge through the nozzle hole 1 or to increase the discharge velocity, the amount of insertion of the tip end 11*a* relative to the supply passage 3 is increased to increase the fluid resistance.

According to the inkjet apparatus I1 having the aforementioned structure, the rod 11 having the circular cone-shape tip end 11*a* is inserted into the fluid supply chamber 4 such that the tip end 11*a* is positioned to face the opening 3*a* of the supply passage 3 and the tip end 11*a* can enter into and retract from the supply passage 3. Therefore, the velocity and the amount of the ink discharge can be suitably set, thereby obtaining the best discharge characteristics. In addition, the fluid resistance is changed by changing the throttled amount of the aperture of the supply passage 3 and this mechanism is disposed in the fluid supply chamber 4 which is outside of the supply passage 3. That is, the space for disposing the movable member 15 (the rod 11) composing the resistance adjusting mechanism 10 can be easily ensured, thereby preventing the increase in size of the inkjet apparatus I1. Though the movable member 15 may be disposed in the pressure chamber 2 because of the easy to ensure the installation space, disposing in the fluid supply chamber 4 has an advantage in that the pressure fluctuation acting on the movable member 15 must be small so as to obtain improved operability of the movable member 15.

The printer head H1 is composed of a plurality of the inkjet apparatuses I1 which are aligned and the integral head body 7. In the printer head H1, each nozzle hole 1, each pressure chamber 2, and each supply passage 3 are formed for each inkjet apparatus I1. On the other hand, the fluid supply chamber 4 is composed of a common single space. The plurality of rods 11 are arranged integrally inside the fluid supply chamber 4. Therefore, just by setting the spaces between the tip ends 11*a* of the respective rods 11 and the openings 3*a* equally, the fluid resistances of the respective supply passages 3 can be concurrently and uniformly changed, thus achieving the simplification of the structure of the printer head H1. Since the plurality of rods 11 compose the integral movable member 15 as mentioned above, the single drive unit 16 is enough to set the fluid resistances in the supply passages 3, thus achieving the simplification of the structure of the printer head H1.

It is preferable that the tip end 11*a* of each rod 11 is formed to have a gently inclined peripheral surface. Since this arrangement moderates variation in the opening area of the supply passage 3 according to the insertion amount of the tip end 11*a*, the change in fluid resistance can be controlled precisely. The tip end 11*a* of the rod 11 is not limited to be formed into a circular cone shape and may be formed into any cone shape so long as it has a tapered periphery.

Figure 6:
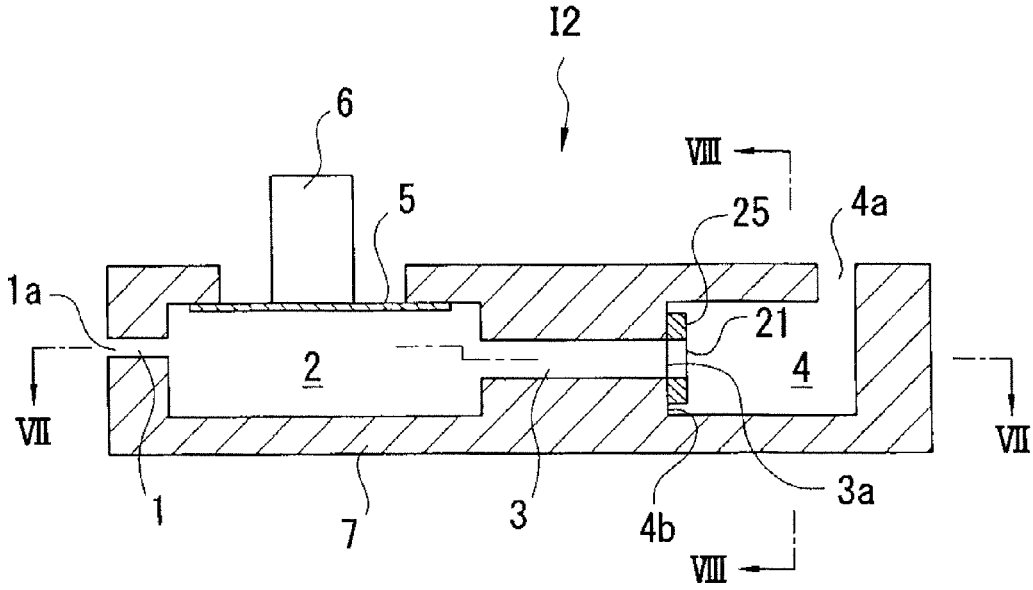
FIG. 6 is a front sectional view of inkjet apparatuses provided with a resistance adjusting mechanism according to a second embodiment of the present invention.
Figure 7:
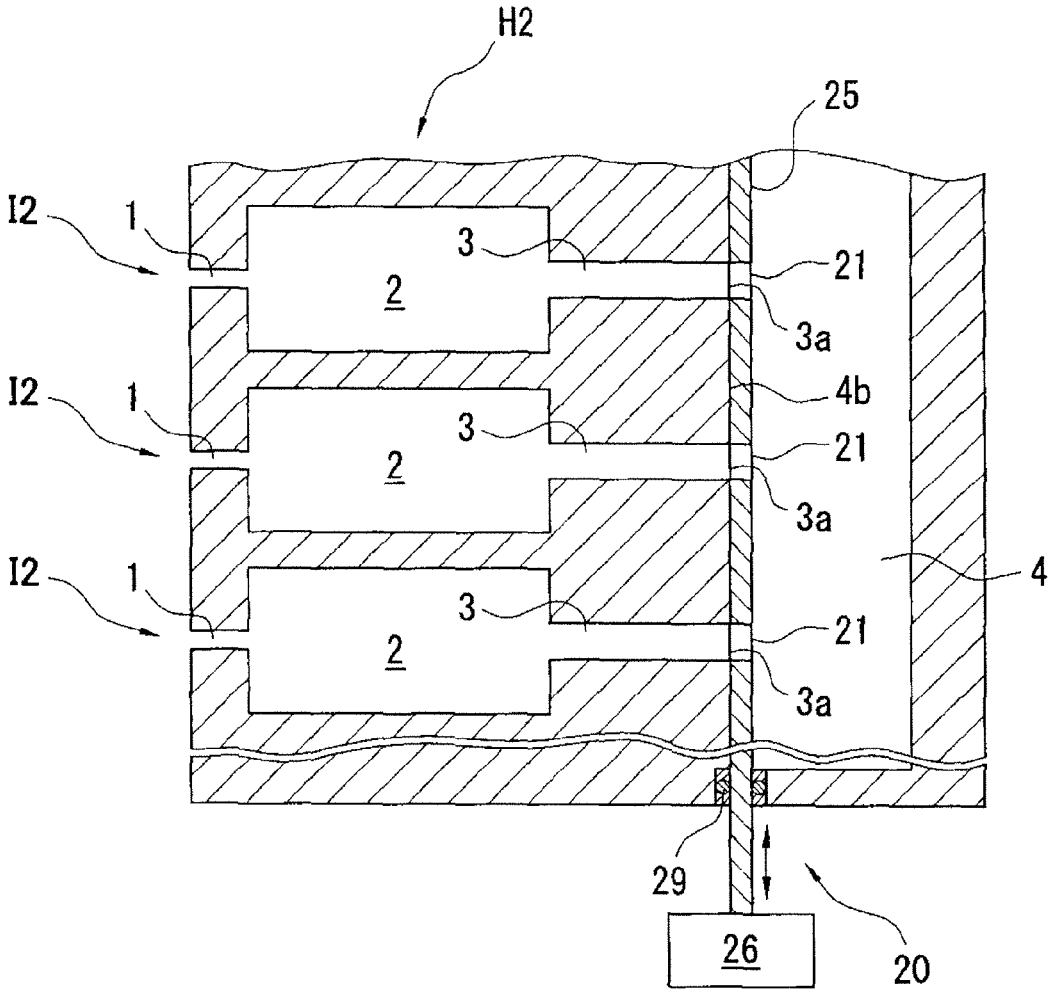
FIG. 7 is a plan sectional view of the inkjet apparatuses taken along a line shown by arrows VII-VII of FIG. 6.

Hereinafter, a resistance adjusting mechanism 20 of a second embodiment will be described with reference to FIG. 6 through FIG. 8. The same components will be represented by the same numerals as those in the aforementioned embodiment, and will not be described to avoid duplication.

The resistance adjusting mechanism 20 has a plate 25 which is provided with a plurality of through holes 21 aligned along a lateral direction and spaced each other at the same intervals as the intervals of the supply passages 3. The plate 25 is disposed on a wall 4*b*, at which the supply passages 3 open, within the fluid supply chamber 4. The plate 25 is inserted through a side wall of the head body 7 and is moved to slide relative to the wall 4*b* by a drive unit 26 which is disposed outside of the head body 7.

The head body 7 is provided with a sealing member 29 at a portion through which the plate 25 is inserted. Though each through hole 21 is formed into a circular shape such that the diameter of each through hole 21 is smaller than that of the opening 3*a* of each supply passage 3 in the illustrate example, the diameter of each through hole 21 may be larger than that of the opening 3*a*.

Figure 8A:
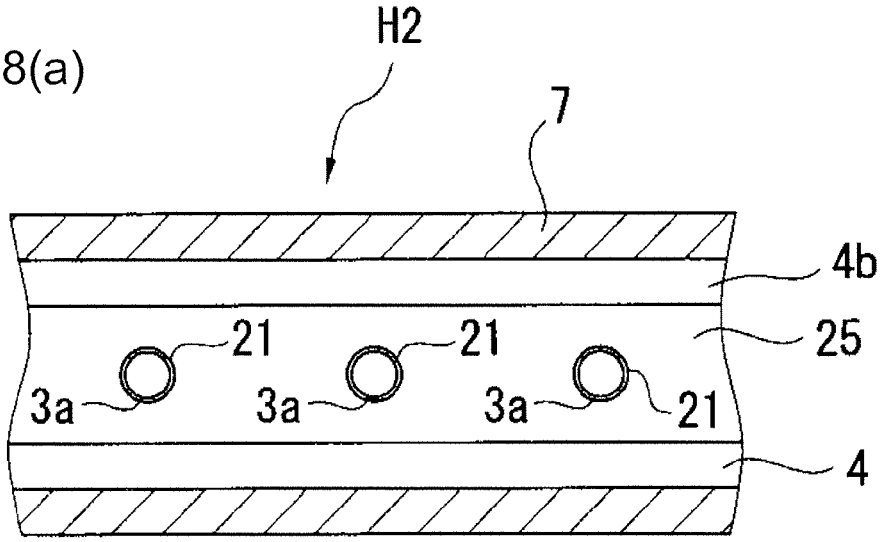
FIGS. 8(*a*) and 8(*b*) are side sectional views of the inkjet apparatuses taken along a line shown by arrows VIII-VIII of FIG. 6.
Figure 8B:
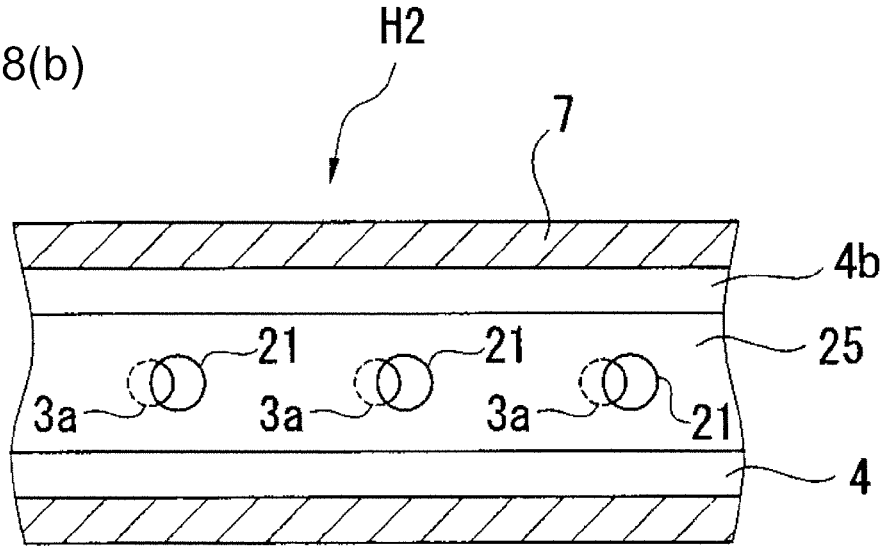

As shown in FIG. 8(*a*), when the through holes 21 of the plate 25 are positioned coaxially with the openings 3*a* of the supply passages 3, the overlapped areas between the through holes 21 and the openings 3*a* of the supply passages 3 are the maximum. The overlapped areas allow communication between the supply passages 3 and the fluid supply chamber 4. The state illustrated in FIG. 8(*a*) is a state that the fluid resistances in the supply passages 3 are set to the minimum because the areas are the maximum.

On the other hand, as shown in FIG. 8(*b*), when the plate 25 is moved to laterally slide by the drive unit 26, the through holes 21 move relative to the openings 3*a* of the supply passages 3 so as to reduce the overlapped areas and thus to increase the fluid resistances in the supply passages 3. By controlling the slide amount from the state illustrated in FIG. 8(*a*), the overlapped areas are changed so as to control the fluid resistances in the supply passages 3.

Since the flat plate 25 is disposed along the wall 4*b* at which the supply passages 3 open, the occupied space in the fluid supply chamber 4 is smaller than that of the first embodiment, thus avoiding the increase in size of the fluid supply chamber 4.

While each nozzle hole 1, each pressure chamber 2, and each supply passage 3 are formed for each inkjet apparatus I2, the fluid supply chamber 4 is composed of a common single space and the openings 3*a* of the supply passages 3 are aligned at the same wall 4*b*. In the printer head H2 of this structure, the resistance adjusting mechanism 20 is arranged inside the fluid supply chamber 4. Therefore, just by setting the intervals of the through holes 21 equal to the intervals of the openings 3*a*, the fluid resistances of the respective supply passages 3 can be concurrently and uniformly changed just by the single plate 25, thus achieving the simplification of the structure of the printer head H2.

Though the slide direction of the plate 25 is not limited to the alignment direction of the openings 3*a*, 3*a*, . . . of the supply passages in this embodiment, the arrangement that the plate 25 is adapted to slide in the alignment direction as mentioned above can omit the mechanism for guiding the slide movement when the plate 25 is formed to have a height equal to the height of the wall 4*b*, thereby achieving the further simplification of the structure.

Hereinafter, a resistance adjusting mechanism 30 of a third will be described with reference to FIGS. 9(*a*), 9(*b*). The resistance adjusting mechanism 30 is provided with a plurality of plates each of which is provided with a plurality of through holes aligned similarly to the second embodiment which are selectable to change the opening areas of the supply passages 3. The diameter of the through hole is different from one plate to another. The through holes of each plate are formed to be positioned coaxially with the openings of the supply passages. Each plate is adapted to be disposed on the wall 4*b*, at which the supply passages open, within the fluid supply chamber 4. The head body 7 is structured such that each plate can be detachably attached thereto. For example, the head body 7 is provided with an opening, not shown, allowing communication between the outside and the fluid supply chamber 4 and a closure member for covering the opening. In addition, a holding mechanism for holding the plate in contact with the wall inside the fluid supply chamber 4 is preferably provided.

Figure 9A:
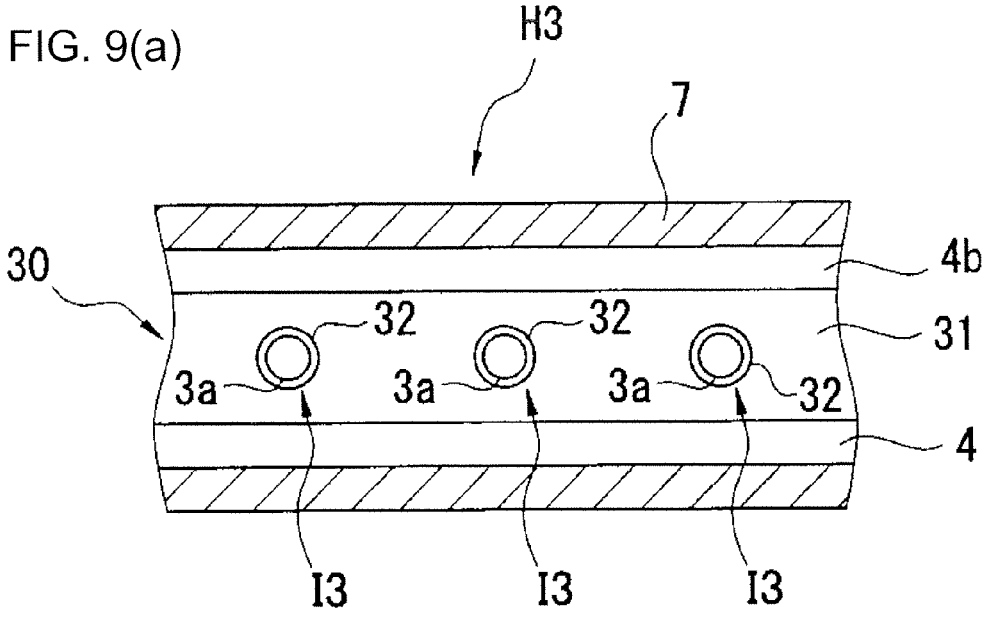
FIGS. 9(*a*) and 9(*b*) are side sectional views of inkjet apparatuses provided with a resistance adjusting mechanism according to a third embodiment of the present invention.
Figure 9B:
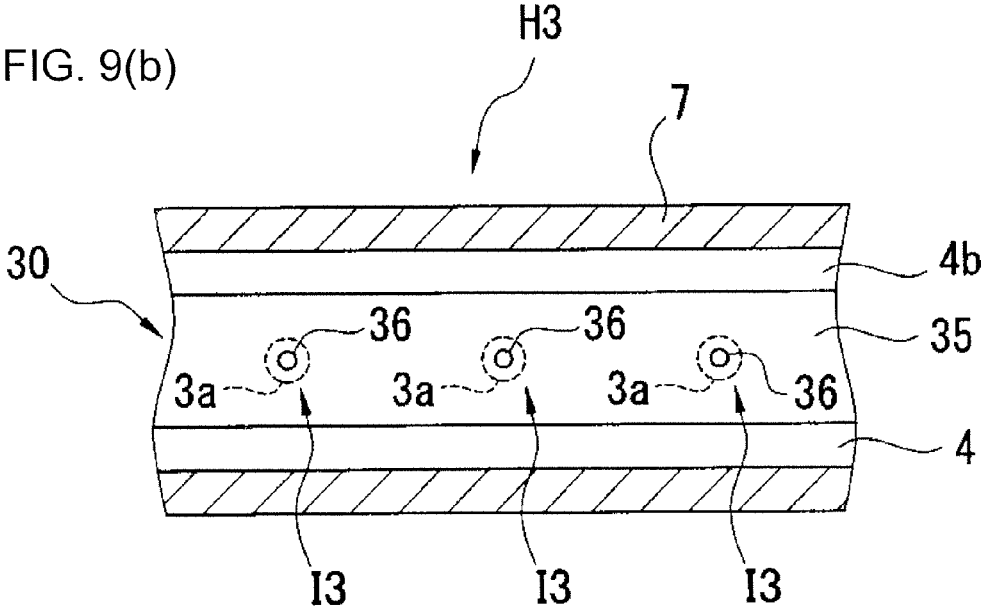

FIGS. 9(*a*), 9(*b*) illustrate two plates: first and second plates 31 and 35. FIG. 9(*a*) shows a state that the first plate 31 of which through holes 32 have a diameter larger than that of the openings 3*a* of the supply passages 3. In this state, overlapped portions between the through holes 32 and the openings 3*a* of the supply passages 3 are equal to the openings 3*a* of the supply passages 3, that is, the openings 3*a* of the supply passages 3 are the apertures for allowing communication between the supply passages 3 and the fluid supply chamber 4. That is, the inkjet apparatus I3 with the first plate 31 is set in a state that the fluid resistances in the supply passages 3 are the minimum. FIG. 9(*b*) shows a state that the second plate 35 of which through holes 36 have a diameter smaller than that of the openings 3*a* of the supply passages 3. In this state, the overlapped portions as mentioned above are equal to the through holes 36, that is, the through holes 36 are the apertures for allowing communication between the supply passages 3 and the fluid supply chamber 4. That is, the aperture area is smaller than that of the case shown in FIG. 9(*a*) so that the fluid resistances in the supply passages 3 are larger.

In this manner, by previously preparing a plate having through holes which are formed to obtain desired discharge velocity and discharge amount, the setting about the fluid resistances in the supply passages 3 can be suitably changed before printing.

Similarly to the second embodiment, this embodiment also can provide an inkjet apparatus I3 and a printer head H3 without increasing the size. Just by changing a piece of plate to be attached, the opening areas of the plurality of the supply passages can be concurrently and uniformly changed. This embodiment may have any structure so long as that it allows a plurality of prepared plates to be selected. In this embodiment, the sealing members 19, 29, 49 used in the first and second embodiments and a fourth embodiment as will be described later can be omitted.

Figure 10:
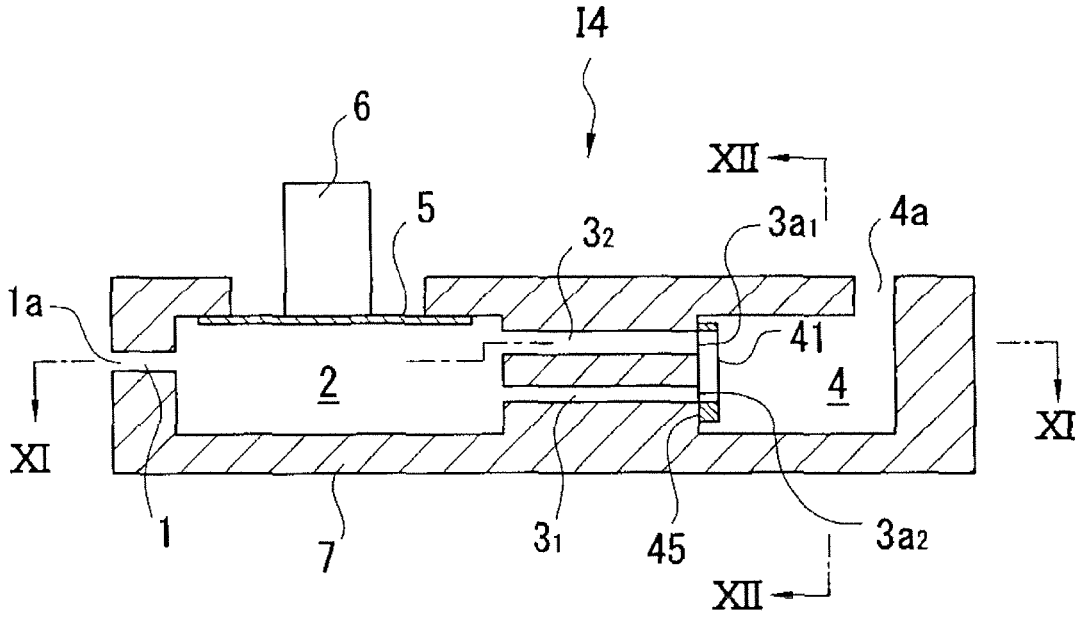
FIG. 10 is a front sectional view of inkjet apparatuses provided with a resistance adjusting mechanism according to a fourth embodiment of the present invention.
Figure 11:
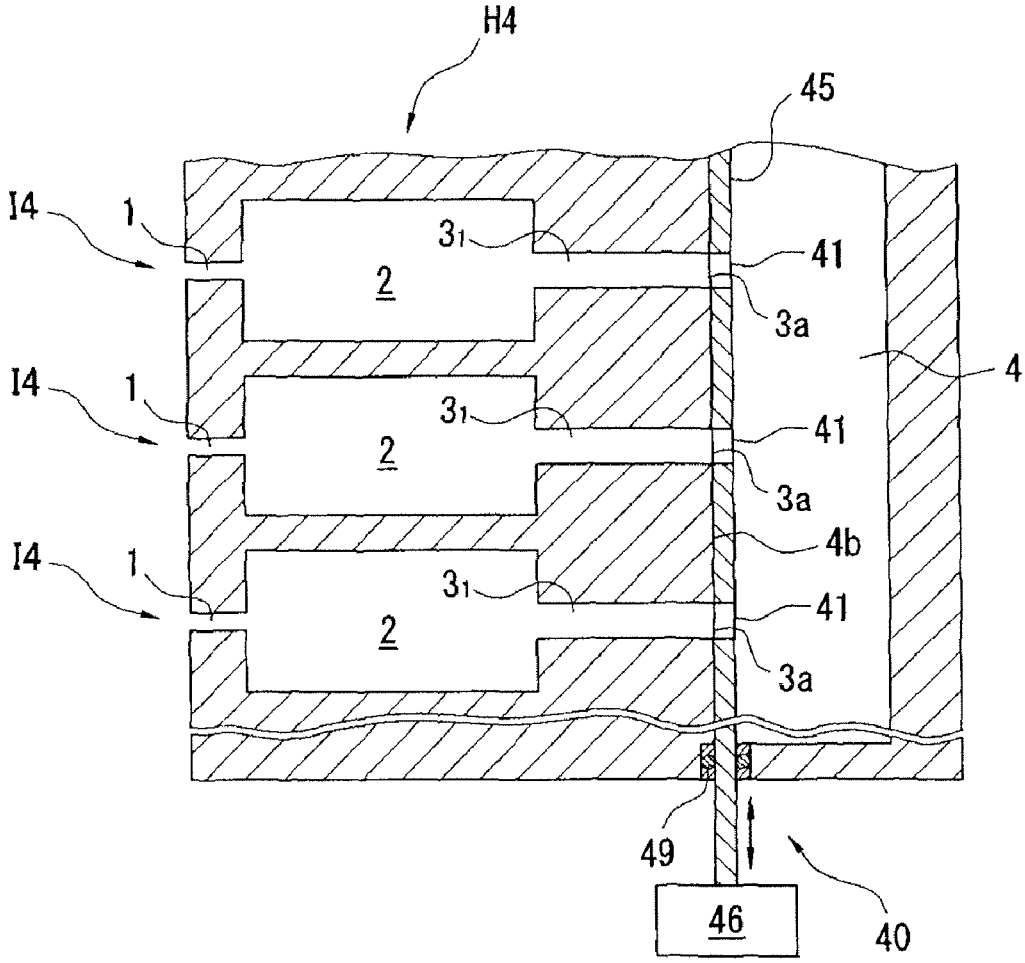
FIG. 11 is a plan sectional view of the inkjet apparatuses taken along a line shown by arrows XI-XI of FIG. 10.

Hereinafter, a resistance adjusting mechanism 40 of the fourth embodiment will be described with reference to FIG. 10 through FIG. 12. In this embodiment, the structure of an inkjet apparatus I4 is different from that of the aforementioned embodiments. As shown in FIG. 10, the inkjet apparatus is provided with two supply passages 3, connecting the pressure chamber 2, which are arranged above and below. The supply passages $\mathbf{3}_1$, $\mathbf{3}_2$ are formed to have cross-sectional areas different from each other (in the illustrated example, the cross-sectional area of the upper supply passage $\mathbf{3}_1$ is larger than the cross-sectional area of the lower supply passage $\mathbf{3}_2$). As shown in FIG. 11, a printer head H4 is composed of a plurality of the inkjet apparatuses I4 which are aligned along a lateral direction so that the upper and lower supply passages $\mathbf{3}_1$, $\mathbf{3}_2$ are aligned in lateral directions, respectively, and open at the wall 4*b* of the fluid supply chamber 4 composed of a single common space.

Figure 12A:
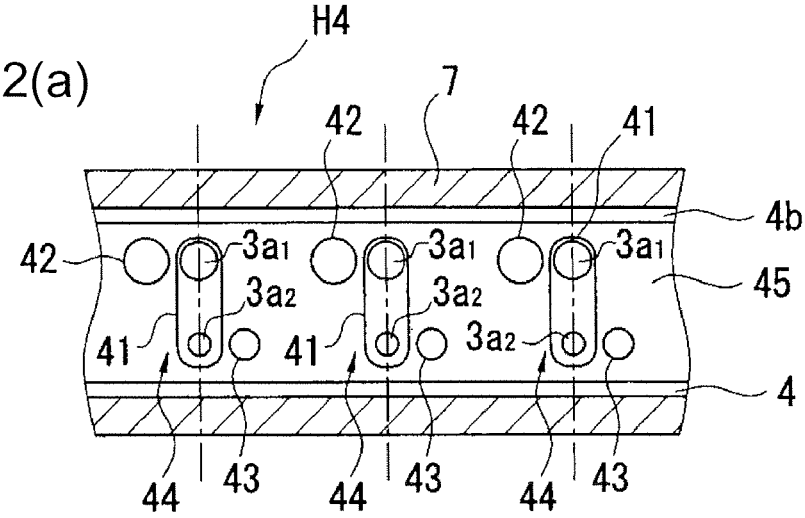
FIGS. 12(*a*), 12(*b*), and 12(*c*) are side sectional views of the inkjet apparatuses taken along a line shown by arrows XII-XII of FIG. 10.
Figure 12B:
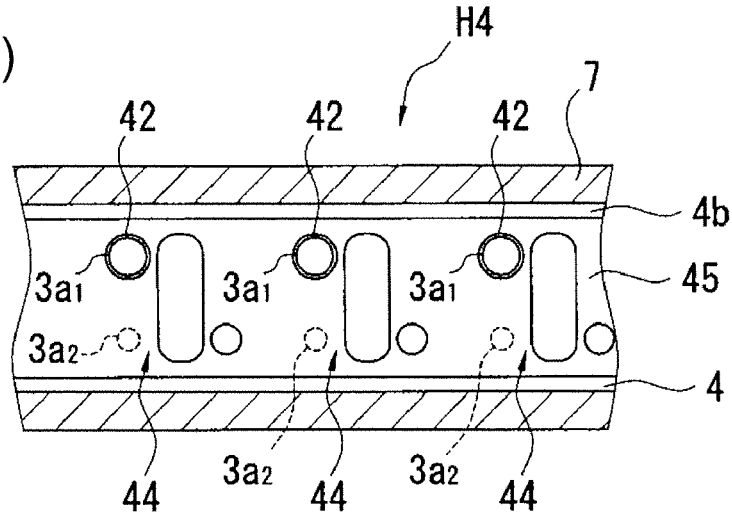
Figure 12C:
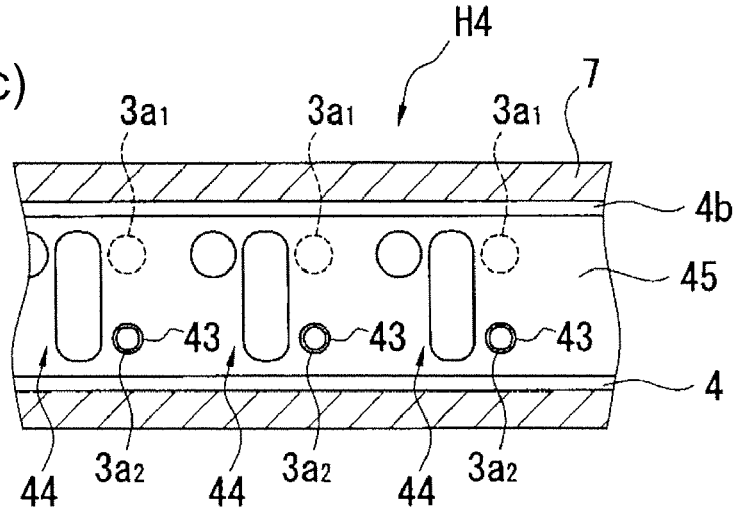
Figure 13:
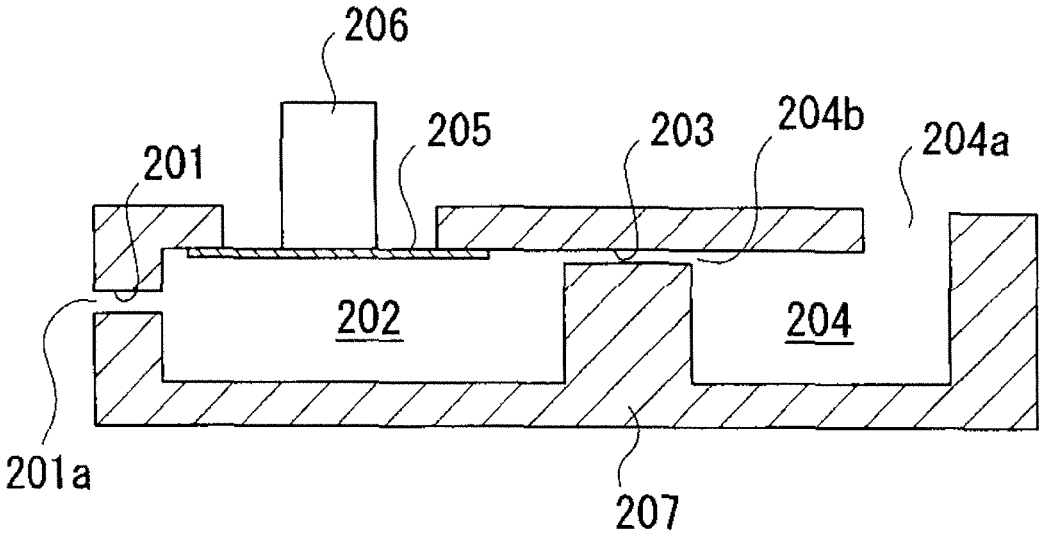
BACKGROUND ART FIG. 13
FIG. 13 is a front sectional view of a conventional inkjet apparatus.

As shown in FIGS. 12(*a*)-12(*c*), a resistance adjusting mechanism 40 includes a plate 45 which is provided with through hole groups 44 which are aligned along a lateral direction. Each through hole group 44 includes an elongate hole 41 extending vertically, an upper through hole 42 adjacent to an upper part of the elongate hole 41 on the left side of the same, and a lower through hole 43 adjacent to a lower part of the elongate hole 41 on the right side of the same. The elongate hole 41 of the through hole group 44 is formed such that the center distance between assumed circles of the elongate hole 41 is equal to the center distance between the supply passages $\mathbf{3}_1$ and $\mathbf{3}_2$. Similarly to the second embodiment, the plate 45 is inserted from a side wall of the head body 7 to come in face-to-face contact with the wall 4*c* at which the supply passages $\mathbf{3}_1$, $\mathbf{3}_2$ open and is moved to slide relative to the wall 4*b* by a drive unit 46 which is disposed outside of the head body 7. The head body 7 is provided with a sealing member 49 at a portion through which the plate 45 is inserted.

As shown in FIG. 12(*a*), when the axis extending in the longitudinal direction of the elongate hole 41 of the plate 45 is coincide with the center line extending in a direction connecting the axes of the openings $\mathbf{3}a_1$, $\mathbf{3}a_2$ of the supply passages 3, both the upper and lower supply passages $\mathbf{3}_1$, $\mathbf{3}_2$ fully open to the fluid supply chamber 4. Accordingly, the pressure chamber 2 and the fluid supply chamber 4 communicate with each other via both the upper and lower supply passages $\mathbf{3}_1$, $\mathbf{3}_2$. As seen as the supply passage overall, the opening section areas are the maximum so that the fluid resistance is set to the minimum.

FIG. 12(*b*) shows a state that, after the plate 45 is moved to slide rightward by the drive unit 46 so that the position of the through hole group 44 is moved relative to the openings $\mathbf{3}a_1$, $\mathbf{3}a_2$ of the supply passages $\mathbf{3}_1$, $\mathbf{3}_2$, the upper through hole 42 is positioned coaxially with the opening $\mathbf{3}a_1$ of the upper supply passage $\mathbf{3}_1$. In this state, the lower supply passage $\mathbf{3}_2$ is closed by the plate 45 and the communication between the pressure chamber 2 and the fluid supply chamber 4 is allowed only by the upper supply passage $\mathbf{3}_1$ so that the fluid resistance is larger than that of the state shown in FIG. 12(*a*).

FIG. 12(*c*) shows a state that, after the plate 45 is moved to slide leftward by the drive unit 46 so that the position of the through hole group 44 is moved relative to the openings $\mathbf{3}a_1$, $\mathbf{3}a_2$ of the supply passages $\mathbf{3}_1$, $\mathbf{3}_2$, the lower through hole 43 is positioned coaxially with the opening $\mathbf{3}a_2$ of the lower supply passage $\mathbf{3}_2$. In this state, the upper supply passage $\mathbf{3}_1$ is closed by the plate 45 and the communication between the pressure chamber 2 and the fluid supply chamber 4 is allowed only by the lower supply passage $\mathbf{3}_2$ so that the fluid resistance is still larger than that of the state shown in FIG. 12(*b*) because the cross-sectional area of the lower supply passage $\mathbf{3}_2$ is smaller than that of the upper supply passage $\mathbf{3}_1$.

In the resistance adjusting mechanism 40 of this embodiment, the inkjet apparatus I4 is provided with two supply passages and the through hole group 44 is formed in the plate 45. By moving the through hole group 44 relative to the openings 3*a* of the supply passages 3 to open or close the supply passages, the fluid resistance can be changed in a stepwise fashion.

Similarly to the second embodiment, this embodiment also can provide an inkjet apparatus I4 and a printer head H4 without increasing the size. Just by moving a piece of plate to slide, the opening and closing of the plurality of the supply passages can be concurrently conducted so as to uniformly change the sectional areas of the communicating supply passages.

Though described above are the embodiments in which the fluid discharge apparatus according to the present invention is the inkjet apparatus I and the fluid discharge apparatus assembly according to the present invention is the printer head H, the present invention is not limited to the aforementioned structures. For example, though the rod 11 or the plate 25, 45 for changing the opening area is moved by the drive unit 16, 26, 46 in the first, second, and fourth embodiments, such a member may be built in the fluid supply chamber and the movement amount of the member may be controlled by means of magnetic force of an electric magnet disposed outside the head body 7. This structure eliminates the necessity of forming a hole through which the rod 11 or the plate 25, 45 is inserted and providing a sealing member, thus simplifying the structure.

The fluid discharge apparatus according to the embodiments of the present invention enables a setting of the fluid resistance suitable for the physicality of the fluid and also enables a suitable setting of the discharge velocity and the discharge amount, thereby obtaining the best discharge characteristics. In this case, the resistance adjusting means is disposed inside the fluid supply chamber, thereby easily ensuring the installation space and avoiding the increase in size of the apparatus. Though the resistance adjusting means may be disposed inside the pressure chamber in view of the installation space, it is better for its operability to be placed in the fluid supply chamber than being placed in the pressure chamber because of smaller pressure fluctuation. In this case, by the arrangement capable of changing the area of aperture of the supply passage (i.e. the throttled amount of the aperture), a means for changing the fluid resistance in the supply passage, having a simple structure, is achieved. In an embodiment in which the area of aperture of the supply passage is changed by moving the aperture setting member, the aperture setting member is adapted to be moved by magnetic force generated outside, thereby allowing the aperture setting member to be built in the fluid supply chamber. This structure eliminates the necessity of giving consideration to sealing, thereby simplifying the structure of the apparatus.

The same effects as mentioned above can be obtained also in the fluid discharge apparatus assembly composed of a plurality of the aforementioned fluid discharge apparatuses which are aligned. In this case, a plurality of fluid supply chambers of the respective fluid discharge apparatuses are composed of a single common space and the aperture setting members of the resistance adjusting means are formed integrally, thereby concurrently changing the setting of the respective opening areas of the plurality of supply passages just by moving or selectively attaching the integrally formed aperture setting member(s) and thus achieving simple structure of the assembly. In the fluid discharge apparatus assembly composed of the plurality of fluid discharge apparatuses having the aperture setting member which is movable, the aperture setting member is adapted to be moved by a single drive unit, thereby simplifying the structure of the assembly.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A liquid discharge apparatus comprising:

a nozzle;

a pressure chamber in which a liquid pressure is configured to be changed to discharge liquid from the nozzle;

a liquid supply chamber;

a liquid supply passage extending in a connecting direction to connect the liquid supply chamber and the pressure chamber; and a fluid resistance changing mechanism configured to change a fluid resistance of the liquid supply passage, wherein the fluid resistance changing mechanism comprises an area changing unit comprising a slidable member and a driver configured to slide the slidable member to change an opening area of a liquid supply passage opening via which the liquid supply passage opens to the liquid supply chamber.

2. The liquid discharge apparatus according to claim 1, wherein the slidable member is a slidable plate having an adjusting opening and the driver is configured to slide the slidable plate in a plane substantially perpendicular to the connecting direction to adjust the overrapping area of the adjusting opening and the liquid supply passage opening.

3. The liquid discharge apparatus according to claim 2, wherein a cross-sectional area of the adjusting opening is smaller than a cross-sectional area of the liquid supply passage opening.

4. The liquid discharge apparatus according to claim 2, wherein the driver is configured to slide the slidable plate by magnetic force.

5. The liquid discharge apparatus according to claim 1, wherein the fluid resistance changing mechanism is provided in the liquid supply chamber.

6. A liquid discharge apparatus comprising:

a nozzle;

a pressure chamber in which a liquid pressure is configured to be changed to discharge liquid from the nozzle;

a liquid supply chamber;

a liquid supply passage extending in a connecting direction to connect the liquid supply chamber and the pressure chamber; and a fluid resistance changing mechanism configured to change a fluid resistance of the liquid, wherein the fluid resistance changing mechanism comprises an area changing unit configured to change an opening area of a liquid supply passage opening via which the liquid supply passage opens to the liquid supply chamber, and wherein the area changing unit comprises a cone and a driver which is configured to move the cone along the connecting direction to adjust the opening area of the liquid supply passage.

7. The liquid discharge apparatus according to claim 6, wherein the cone comprises a conical body.

8. The liquid discharge apparatus according to claim 6, wherein the driver is configured to move the cone by magnetic force.

9. The liquid discharge apparatus according to claim 6, wherein the fluid resistance changing mechanism is provided in the liquid supply chamber.

10. A liquid discharge apparatus comprising:

a nozzle;

a pressure chamber in which a liquid pressure is configured to be changed to discharge liquid from the nozzle;

a liquid supply chamber;

a liquid supply passage extending in a connecting direction to connect the liquid supply chamber and the pressure chamber; and a fluid resistance changing mechanism configured to change a fluid resistance of the liquid, wherein the fluid resistance changing mechanism comprises an area changing unit configured to change an opening area of a liquid supply passage opening via which the liquid supply passage opens to the liquid supply chamber, and wherein the area changing unit comprises a first plate having a first adjusting opening and a second plate having a second adjusting opening whose cross-sectional area is smaller than a cross-sectional area of the first adjusting opening, either one of the first plate or the second plate is provided in the liquid supply chamber so that the first adjusting opening or the second adjusting opening faces the liquid supply passage opening.

11. The liquid discharge apparatus according to claim 10, wherein the fluid resistance changing mechanism is provided in the liquid supply chamber.

12. A liquid discharge apparatus comprising:

a nozzle;

a pressure chamber in which a liquid pressure is configured to be changed to discharge liquid from the nozzle;

a liquid supply chamber;

a liquid supply passage extending in a connecting direction to connect the liquid supply chamber and the pressure chamber; and a fluid resistance changing mechanism configured to change a fluid resistance of the liquid, wherein the fluid resistance changing mechanism comprises an area changing unit configured to change an opening area of a liquid supply passage opening via which the liquid supply passage opens to the liquid supply chamber, wherein the liquid supply passage includes a first liquid supply passage and a second liquid supply passage having a cross-sectional area smaller than a cross-sectional area of the first liquid supply passage, the first liquid supply passage opening to the liquid supply chamber via a first liquid supply passage opening, the second liquid supply passage opening to the liquid supply chamber via a second liquid supply passage opening, and wherein the area changing unit comprises a slidable plate and a driver configured to slide the slidable plate to open the first liquid supply passage opening and/or the second liquid supply passage opening.

13. The liquid discharge apparatus according to claim 12, wherein the driver is configured to slide the slidable plate by magnetic force.

14. The liquid discharge apparatus according to claim 12, wherein the fluid resistance changing mechanism is provided in the liquid supply chamber.

15. A liquid discharge apparatus comprising:

a nozzle;

a pressure chamber in which a liquid pressure is configured to be changed to discharge liquid from the nozzle;

a liquid supply chamber;

a liquid supply passage extending in a connecting direction to connect the liquid supply chamber and the pressure chamber; and a fluid resistance changing mechanism configured to change a fluid resistance of the liquid, wherein the fluid resistance changing mechanism comprises an area changing unit configured to change an opening area of a liquid supply passage opening via which the liquid supply passage opens to the liquid supply chamber, and wherein the fluid resistance changing mechanism is provided in the liquid supply chamber.

16. A liquid discharge apparatus comprising:

a nozzle;

a pressure chamber in which a liquid pressure is configured to be changed to discharge liquid from the nozzle;

a liquid supply chamber;

a liquid supply passage extending in a connecting direction to connect the liquid supply chamber and the pressure chamber; and fluid resistance changing means for changing a fluid resistance of the liquid supply passage, wherein the fluid resistance changing means comprises a slidable member and a driver configured to slide the slidable member to change an opening area of a liquid supply passage opening via which the liquid supply passage opens to the liquid supply chamber.

17. The liquid discharge apparatus according to claim 16, wherein the fluid resistance changing means is provided in the liquid supply chamber.

18. A liquid discharge device group comprising:

a common liquid supply chamber; and a plurality of liquid discharge devices, each of the plurality of liquid discharge devices comprising:

a nozzle;

a pressure chamber in which a liquid pressure is configured to be changed to discharge liquid from the nozzle;

a liquid supply passage extending in a connecting direction to connect the common liquid supply chamber and the pressure chamber; and a fluid resistance changing mechanism configured to change a fluid resistance of the liquid supply passage, wherein the fluid resistance changing mechanism comprises an area changing unit comprising a slidable member and a driver configured to slide the slidable member to change an opening area of a liquid supply passage opening via which the liquid supply passage opens to the common liquid supply chamber.

19. The liquid discharge device group according to claim 18, wherein the slidable member is a slidable plate having a plurality of adjusting openings corresponding to a number of the plurality of liquid discharge devices and the driver is configured to slide the slidable plate in a plane substantially perpendicular to the connecting direction to adjust the overrapping area of each of the plurality of adjusting openings and each liquid supply passage opening.

20. The liquid discharge device group according to claim 18, wherein the fluid resistance changing mechanism is provided in the liquid supply chamber.

* * * * *